US005150964A

United States Patent [19]

Tsui

[11] Patent Number: 5,150,964

[45] Date of Patent: Sep. 29, 1992

[54] JOY LIGHT STRUCTURE

[76] Inventor: Pui-Hing Tsui, Room 1505, 15/F., Fullagar Industrial Building, 234 Aberdeen Main Road, Aberdeen, Hong Kong, Hong Kong

[21] Appl. No.: 719,029

[22] Filed: Jun. 21, 1991

[51] Int. Cl.[5] ..... F21V 23/04; F21P 1/02

[52] U.S. Cl. ..... 362/251; 362/122; 362/226; 362/249; 362/806; 362/252

[58] Field of Search ..... 362/122, 123, 226, 231, 362/249, 251, 252, 391, 407, 806, 807, 810, 811

[56] References Cited

U.S. PATENT DOCUMENTS

| | | | |
|---|---|---|---|
| 1,974,472 | 9/1934 | Seghers | 362/123 |
| 2,692,375 | 10/1954 | Carson | 362/391 |
| 4,234,915 | 11/1980 | Malinowski et al. | 362/391 |
| 4,516,193 | 5/1985 | Murphy | 362/806 |
| 4,777,573 | 10/1988 | Liao | 362/249 |
| 4,812,956 | 3/1989 | Chen | 362/249 |
| 4,920,467 | 4/1990 | Honsberger | 362/811 |

FOREIGN PATENT DOCUMENTS

| | | | |
|---|---|---|---|
| 198431 | 12/1964 | Sweden | 362/391 |
| 896586 | 5/1962 | United Kingdom | 362/391 |

*Primary Examiner*—Ira S. Lazarus
*Assistant Examiner*—Y. Quach
*Attorney, Agent, or Firm*—Ladas & Parry

[57] ABSTRACT

An improved structure of a joy light which is convenient for assembly, safe for use and variable for flash function. The structure comprises a channel and frequency controller, a main conducting wire, a plurality of sockets and plugs of which the connecting channels are changeable, and a plurality of string lights.

8 Claims, 4 Drawing Sheets

JOY LIGHT STRUCTURE

BACKGROUND OF THE INVENTION

The present invention relates to the structure of joy light, in particular, to the connecting means of the joy light structure to provide variable string light pattern.

As known to those skilled in the art, conventional Christmas lights are usually manufactured by connecting a plurality of string light to the main wire of which the insulating cover is stripped at each connecting point. It is laborious and uneconomical to manufacture the Christmas lights in this manner. In addition, such connecting manner is likely to result in current leakage, and thus it is very inconvenient and unsafe to use such a Christmas light. Further, owing to its poor conductivity and high resistance, the power efficiency of the conventional Christmas light is relatively low.

Accordingly, there is a need for an improved version for the conventional light. The present invention provides a new structure of joy light which is convenient for assembly and is safe for use either indoors or outdoors.

SUMMARY OF THE INVENTION

It is a primary object of the present invention to provide an improved structure of joy light which is convenient for assembly and can be varied its connecting pattern according to the desired light flashing patterns.

It is another object of the present invention to provide an improved structure of joy light having relatively low electric resistance.

It is a further object of the present invention to provide an improved structure of joy light which is very safe and free from current leakage.

These and other objects, advantages and features of the present invention will be more fully understood and appreciated by reference to the written specification.

According to the present invention, the structure of joy light essentially comprises a main conducting wire, a channel and frequency controller, a plurality of sockets and plugs of which the connecting channels are changeable, and a plurality of string lights. The controller controls the flash module of frequency and channel. The control signals are transmitted to the main conducting wire so that all string lights connecting to the main conducting wire flash in accordance with the controlled module. All string lights are connected to the main conducting wire by inserting the plugs of string lights into the sockets of the main conducting wire. Since the channels of the sockets are selectable, the string lights flash according to the predetermined control module and the variation of the connecting manner. Besides, the plug is provided with water-proof rubber ring to avoid moisture permeation and thus the joy lights are suitable for indoor and outdoor application. The bulbs used in the joy light are the tiny bulbs of 3*6 mm. The bulbs are directly connected to the wire of the lights and are sealed by means of insulating housing at the connecting positions. The durability of the bulb can be lasted for a minimum of 30,000 hours.

BRIEF DESCRIPTION OF THE DRAWINGS

The present invention will be further explained with reference to the annexed drawings, wherein.

DETAILED DESCRIPTION OF THE INVENTION

Figure 1:
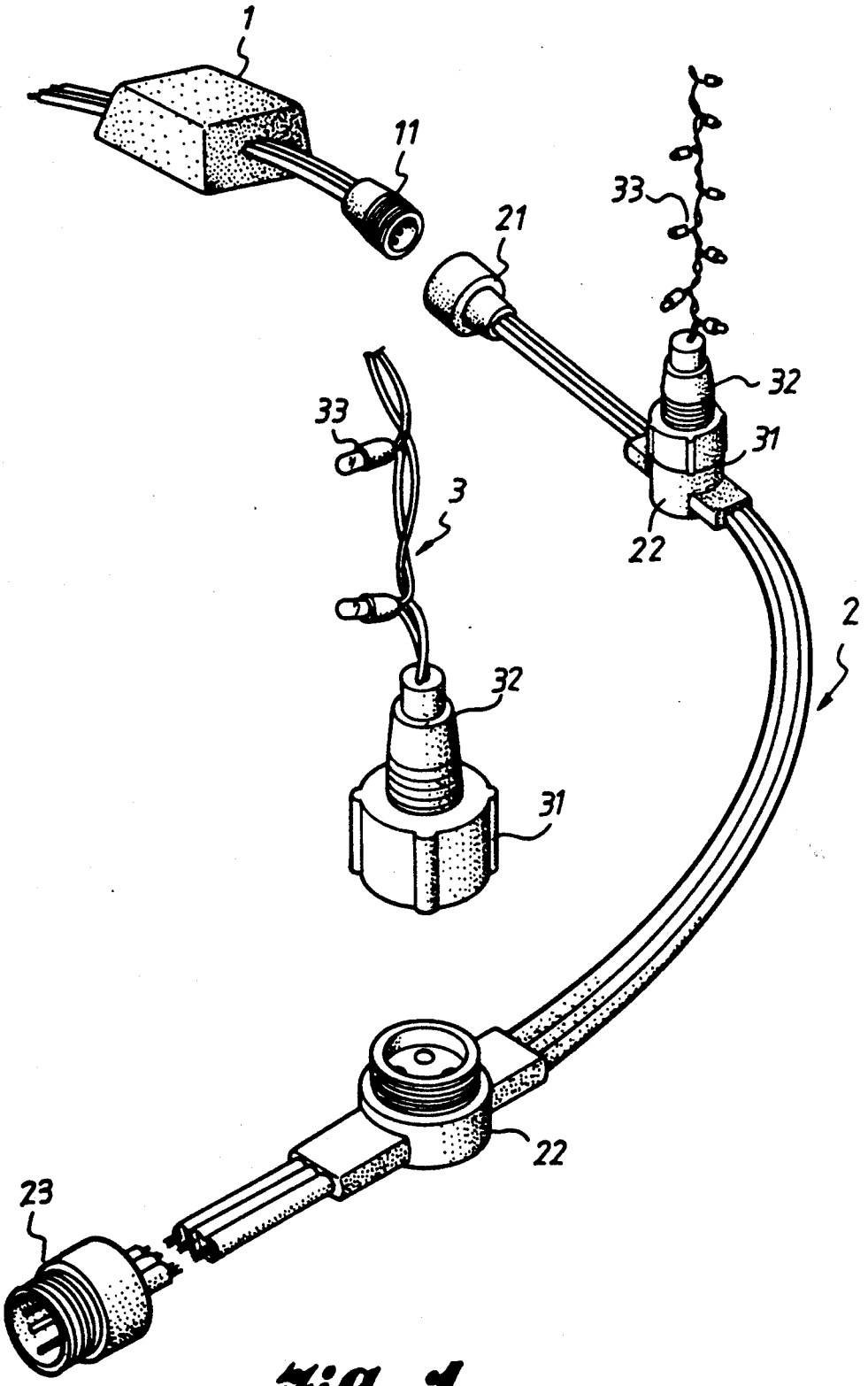
FIG. 1 is a perspective view of the joy light structure in accordance with the present invention.

Referring to FIG. 1, the joy light comprises a channel and frequency controller 1, a main conducting wire 2, and a plurality of string lights 3. The controller 1 transforms the current from the power source into various channels. The frequency controller 1 provides adjustable flashing module frequency and channel. The main conducting wire 2 comprises a controller socket 21 mounted at one end thereof and a connecting plug 23 mounted at the other end thereof, and a plurality of connecting sockets 22 are evenly provided along the conducting wire 2. When the signal plug 11 of the controller 1 is inserted into the controller socket 21 of the main conducting wire 2, the control signals can be transmitted to the main conducting wire 2. The plug 32 of the string light 3 is inserted into the socket 22 of the main conducting wire 2 in accordance with a desired manner so that the controller 1, the main conducting wire 2 and the string lights 3 form a closed loop of circuit. Since the other end of the main conducting wire 2 is provided with a connecting plug 23 to connect with another conducting wire, the length of the main wire is variable desirably.

Figure 2:
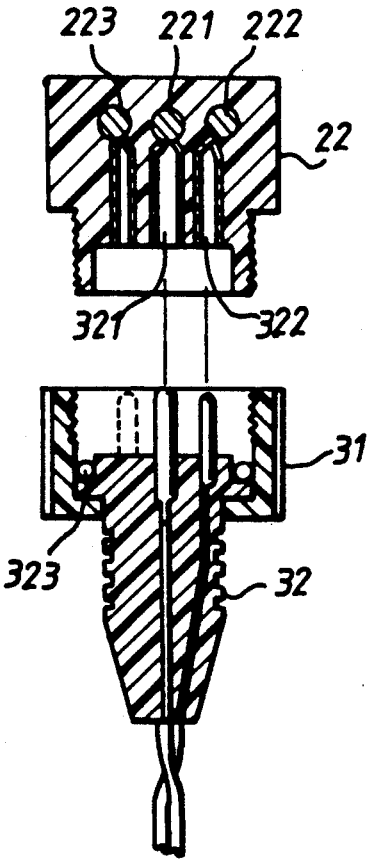
FIG. 2 is a cross-sectional view of the plug and the socket of the joy light structure in accordance with the present invention.

In accordance with the present invention, referring to FIG. 2, the main conducting wire 2 comprises three conductive wires: the common wire 221, the first controlled wire 222, and the second controlled wire 223. The hole in the socket 22 connected with the common wire 221 is slightly larger than the holes connected with the first and second controlled wires 222, 223. Correspondingly, the terminal 321 of the plug 32 for inserting into the hole of the common wire 221 is also larger than the terminal 322 for inserting into the hole of the controlled wire. Accordingly, it is easy to distinguish the common terminal from the controlled terminal so as to insert the plug 32 into the socket 22 correctly and conveniently. After inserting the plug 32 into the socket 22, the fastener 31 of the plug 32 is screwed tight to avoid the disconnection of the plug 32 and the socket 22. The plug 32 is provided with the waterproof ring 323 to prevent moisture permeation and thus the joy light is suitable for use at indoor and outdoor.

Figure 3:
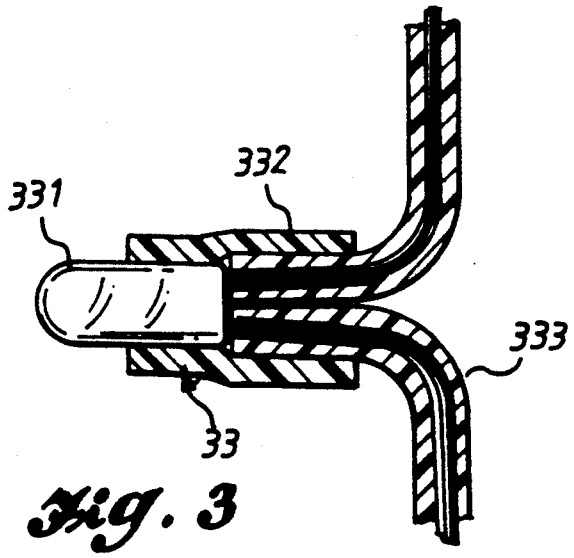
FIG. 3 is a cross-sectional view of the bulb of the joy light structure in accordance with the present invention.

Referring to FIG. 3, the bulb 331 of the joy light is directly connected to the wire 333 of the string lights and is sealed by an insulating housing 332 at the connecting position. Such a connecting manner is easy and convenient. Besides, it does not need the bulb socket for connection. As a result, the cost for the production of the joy light is reduced. The sealing for the bulb of the joy light in accordance with the present invention is better than those of the conventional Christmas lights, and thus the durability of all bulbs of the present joy light are much longer (over 30,000 hours).

Figure 4:
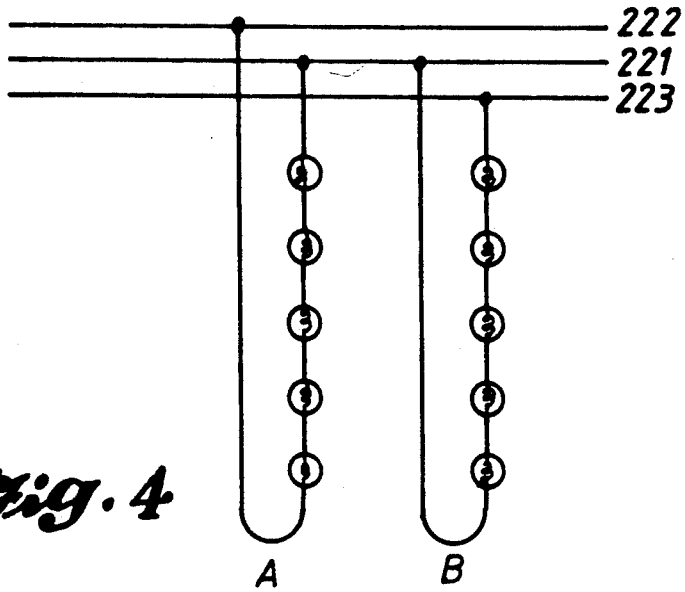
FIG. 4 is a schematic view of the connecting manner for one embodiment in accordance with the present invention.

Referring to FIG. 4, there is shown a schematic view of the connecting manner for one embodiment in accordance with the present invention, wherein one terminal each of string lights A and B are connected to the common wire 221 of the main connecting wire and the other terminal each of string lights A and B are connected to the first controlled wire 222 and second controlled wire 223 respectively, whereby the joy light forms two groups of circuit loop. The string lights A and string lights B can flash in turn or simultaneously so as to achieve four flashing manners.

Figure 5:
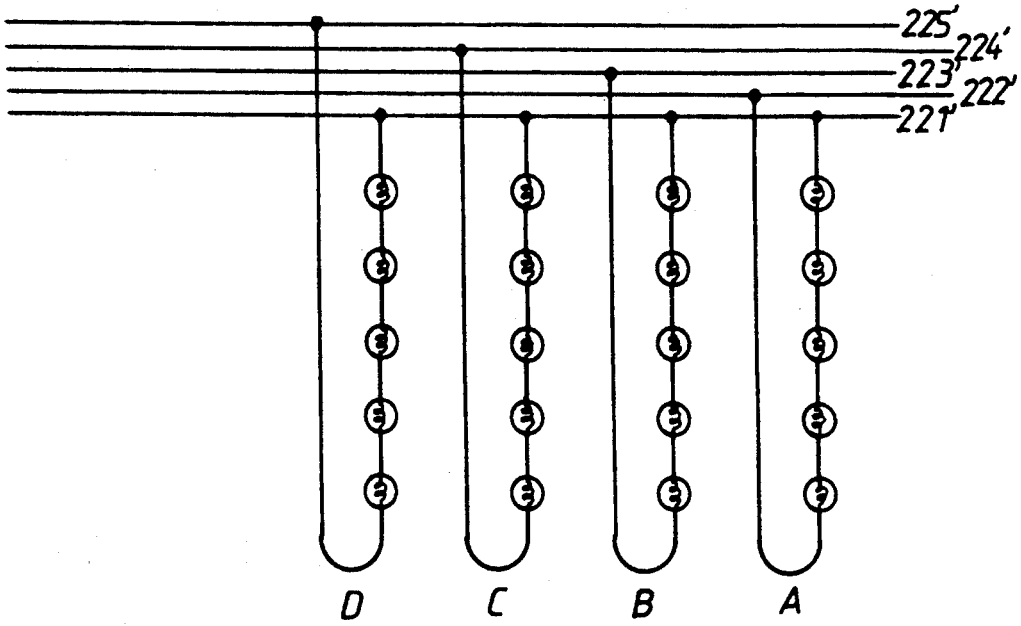
FIG. 5 is a schematic view of the connecting manner for another embodiment in accordance with the present invention.

Referring to FIG. 5, there is shown a schematic view of the connecting manner for another embodiment in accordance with the present invention, wherein one terminal each of string lights A, B, C and D are connected to the common wire 221 of the main connecting wire and the other terminal each of string lights A, B, C and D are connected to the first, second, third and fourth controlled wires 222', 223', 224', 225', respectively, whereby the joy light forms four groups of circuit loop. The string lights A, B, C and D can flash in turn or simultaneously so as to achieve sixteen flashing manners.

Figure 6:
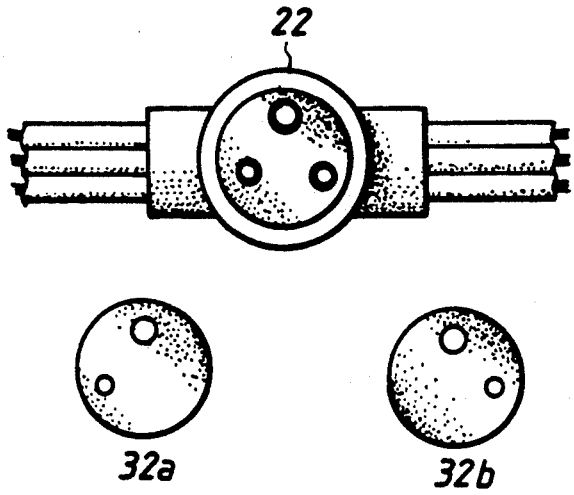
FIG. 6 is a front view of the plug and the socket of the joy light structure in accordance with FIG. 4.

Referring to FIG. 6, there is shown a front view of the socket 22 and plug 32 of the joy light in FIG. 4, wherein the plug 32*a* is for the string lights A and the plug 32*b* is for the string lights B. Therefore, the plug for the string lights can be selected in accordance with the predetermined flash manner so as to form the desired joy light.

Figure 7:
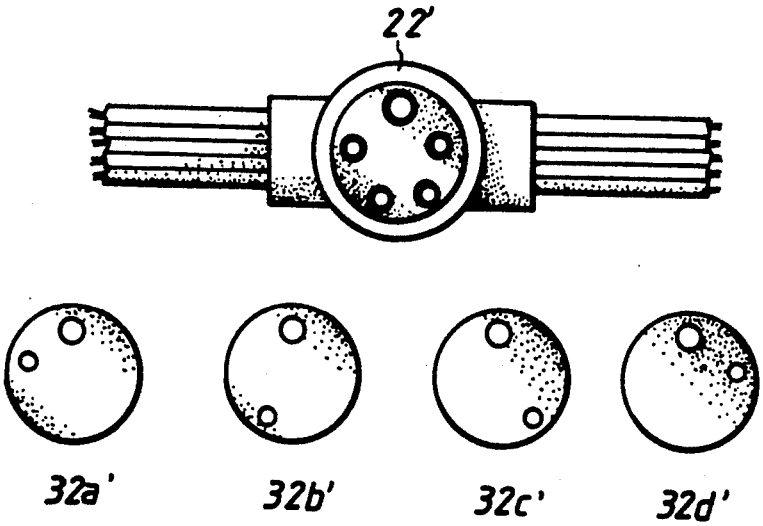
FIG. 7 is a front view of the plug and the socket of the joy light structure in accordance with FIG. 5.

Referring to FIG. 7, there is shown a front view of the socket 22' and plug 32' of the joy light in FIG. 5. The connecting manner is similar to that of the aforesaid embodiment. Therefore, the plug for the string lights can be selected in accordance with the predetermined flash manner so as to form the desired joy light.

In view of the above, the novel creation of the present invention not only solves the problems of the conventional Christmas light but also provides a novel joy light which is convenient for assembly, safe for use and changeable for flashing function.

While only particular embodiments of the present invention have been shown and described herein, it will be appreciated that modifications thereof may be readily made thereto by those skilled in the art. I, therefore, intend by the appended claims to cover the modifications which fall within the true spirit and scope of our invention.

I claim:

1. A joy light structure for variable connecting manner comprising:

(a) a controller (1) for providing an adjustable flashing module frequency signal and a plurality of channels;

(b) at least a main connecting wire (2) having a controller socket (21) at one end thereof for connecting of said main connecting wire (2) to the controller (1), a connecting plug (23) mounted at another end thereof for connecting of said main connecting wire (2) to a further main connecting wire, and at least a socket (22) being provided along said main connecting wire (2); and (c) at least a string light (3) having a plurality of bulbs connected in series and a plug (32) disposed at one end thereof for connecting of the string light (3) to said main connecting wire (2) by inserting the plug (32) into the socket (22) and screwing a fastener (31) of said plug (32) onto said socket (22) the improvement comprising:

said main connecting wire (2) having at least three conductive wires, one being a common wire (221) and the others being controlled wires (222, 223);

at least three holes being provided within said socket (22), one for said common wire (221) and the others for said controlled wires (222, 223);

said plug (32) having two terminals, one terminal (321) for said common wire (221) and another terminal (322) for one of said controlled wires (222, 223);

a water-proof ring (323) being disposed between said plug (32) and socket (22) to prevent moisture permeation when said fastener (31) is screwed tight, whereby said string light (3) flashes in accordance with a flashing module controlled by said controller (1).

2. The joy light structure according to claim 1, wherein the bulbs (33) mounted on said string light (3) are directly connected to a wire (333) of said string light (3) and sealed by an insulating housing (332) at a connection portion therebetween.

3. The joy light structure according to claim 1, wherein the main connecting wire (2) comprises a common wire (221'), a first controlled wire (222'), a second controlled wire (223'), a third controlled wire (224') and a fourth controlled wire (225') respectively.

4. The joy light structure according to claim 3, wherein a plurality of holes are provided within the socket (22), one for the common wire (221') and the others for the first controlled wire (222'), the second controlled wire (223'), the third controlled wire (224') and the fourth controlled wire (225') respectively.

5. The joy light structure according to claim 4, wherein the two terminals of said plug (32) are disposed corresponding to the holes of said socket (22) and are connected to said common wire (221') and the first controlled wire (222') respectively.

6. The joy light structure according to claim 4, wherein the two terminals of said plug (32) are disposed corresponding to the holes of said socket (22) and are connected to said common wire (221') and the second controlled wire (223') respectively.

7. The joy light structure according to claim 4, wherein the two terminals of said plug (32) are disposed corresponding to the holes of said socket (22) and are connected to said common wire (221') and the third controlled wire (224') respectively.

8. The joy light structure according to claim 4, wherein the two terminals of said plug (32) are disposed corresponding to the holes of said socket (22) and are connected to said common wire (221') and the fourth controlled wire (225') respectively.

* * * * *